US008047284B2

(12) United States Patent
Ramurthy et al.

(10) Patent No.: US 8,047,284 B2
(45) Date of Patent: Nov. 1, 2011

(54) DETERMINING THE USE OF STIMULATION TREATMENTS BASED ON HIGH PROCESS ZONE STRESS

(75) Inventors: Muthukumarappan Ramurthy, Commerce City, CO (US); Douglas P. Magill, Bloomfield, NM (US); Donald P. Kundert, Broomfield, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 303 days.

(21) Appl. No.: 12/395,301

(22) Filed: Feb. 27, 2009

(65) Prior Publication Data

US 2010/0218941 A1 Sep. 2, 2010

(51) Int. Cl.

| | |
|---|---|
| ***E21B 47/00*** | (2006.01) |
| ***E21B 43/26*** | (2006.01) |
| ***G01V 9/00*** | (2006.01) |

(52) U.S. Cl. ..... 166/250.02; 73/152.38

(58) Field of Classification Search ..... 166/177.5, 166/308.1, 271, 281, 283, 250.07, 250.02, 166/250.1, 250.16; 73/152.02, 152.38; 702/11
See application file for complete search history.

(56) References Cited

U.S. PATENT DOCUMENTS

| | | | | |
|---|---|---|---|---|
| 4,398,416 | A * | 8/1983 | Nolte | 73/152.39 |
| 5,165,276 | A * | 11/1992 | Thiercelin | 73/152.39 |
| 5,183,109 | A * | 2/1993 | Poulsen | 73/152.39 |
| 5,383,122 | A * | 1/1995 | Ohaeri | 702/13 |
| 6,705,398 | B2 * | 3/2004 | Weng | 166/250.07 |
| 6,860,147 | B2 * | 3/2005 | Gunter et al. | 73/152.05 |
| 2006/0155473 | A1 | 7/2006 | Soliman et al. | |
| 2010/0314104 | A1 * | 12/2010 | Shokanov et al. | 166/250.1 |

OTHER PUBLICATIONS

J. Shlyapobersky, "Energy Analysis of Hydraulic Fracturing," 26th US Symposium on Rock Mechanics, Jun. 26-28, 1985, 9 pages.

J. Shlyapobersky, et al., "Review of Recent Developments in Fracture Mechanics With Petroleum Engineering Applications," SPE 28074, copyright 1994, Society of Petroleum Engineers, pp. 381-389.

J. Shlyapobersky, et al., "Overpressure Calibrated Design of Hydraulic Fracture Stimulations," SPE 18194, copyright 1988, Society of Petroleum Engineers, 16 pages.

(Continued)

*Primary Examiner* — Kenneth L Thompson

(74) *Attorney, Agent, or Firm* — Robert A. Kent; Fish & Richardson P.C.

(57) ABSTRACT

Methods for determining whether to perform a stimulation treatment on a subterranean zone are disclosed. Process zone stress ("PZS"), indicative of a production potential of the subterranean zone, is determined, and a determination is made as to whether the PZS exceeds a preselected value. A PZS exceeding the preselected value may indicate a poor production potential, and a stimulation treatment of the subterranean zone may be avoided. As a result, a substantial cost saving associated with the avoided stimulation treatment may be realized.

23 Claims, 16 Drawing Sheets

OTHER PUBLICATIONS

Kenneth G. Nolte, "Fracturing-Pressure Analysis for Nonideal Behavior," SPE 20704, JPT, Feb. 1991, pp. 210-218.

R.D. Barree, et al., "Holistic Fracture Diagnostics," SPE 107877, copyright 2007, Society of Petroleum Engineers, pp. 1-13.

Kumar Ramurthy, et al., Energy Corporation Well—1, Diagnostic Fracture Injection Tests Proposed Services, Version 1, Apr. 27, 2004, 7 pages.

Kumar Ramurthy, Company X, Well Y, Diagnostic Fracture Injection Test, Version 1, Oct. 18, 2002, 4 pages.

David P. Craig, et al., "Estimating Pore Pressure and Permeability in Massively Stacked Lenticular Reservoirs Using Diagnostic Fracture-Injection Tests," SPE 56600, copyright 1999, Society of Petroleum Engineers, pp. 1-14.

Stimulation, DFIT$^{SM}$Analysis Service, Diagnostic fracture injection test analysis for multiple lenticular zones helps optimize the fracture treatment for each of the viable zones, copyright 2008, Halliburton, 2 pages.

Muthukumarappan Ramurthy, et al., "Diagnostic Fracture Injection Test in Coals to Determine Pore Pressure and Permeability," SPE 75701, copyright 2002, Society of Petroleum Engineers, pp. 1-16.

Muthukumarappan Ramurthy, et al., "Effects of High Process Zone Stress in Shale Stimulation Treatments," SPE 123581, copyright 2009, Society of Petroleum Engineers, pp. 1-15.

Muthukumarappan Ramurthy, et al., "Effects of High Pressure Dependent Leakoff and High Process Zone Stress in Coal Stimulation Treatments," SPE 107971, copyright 2007, Society of Petroleum Engineers, pp. 1-8.

Michael J. Economides, et al., Chapter 5, Reservoir Stimulation, Third Edition , John Wiley and Sons, Ltd., copyright 2000, pp. 5-1—5-28.

Michael J. Economides, et al., Chapter 9, Reservoir Stimulation, Third Edition , John Wiley and Sons, Ltd., copyright 2000, pp. 9-1—9-63.

* cited by examiner

DETERMINING THE USE OF STIMULATION TREATMENTS BASED ON HIGH PROCESS ZONE STRESS

TECHNICAL FIELD

Fracture stimulation of a well, and more particularly to a method and system for determining formation properties. Particularly, this disclosure is directed to determining formation properties associated with production potential from the formation.

BACKGROUND

Oil and gas wells produce oil, gas, and/or by-products from underground reservoirs. Oil and gas reservoirs are formations of rock containing oil and/or gas. The type and properties of the rock may vary by reservoir and also within reservoirs. For example, the porosity and permeability of a reservoir rock may vary from reservoir to reservoir and from well to well in a reservoir. The porosity is the percentage of core volume, or void space, within the reservoir rock that can contain fluids. The permeability is an estimate of the reservoir rock's ability to flow or transmit fluids. A reservoir may include a plurality of reservoir zones, and the zones may have properties different from each other, and the properties within a zone may vary. Further, different reservoir zones may be formed from different types of rock.

Oil and gas production from a well may be stimulated by fracture, acid or other production enhancement treatment. In a fracture treatment, fluids are pumped downhole under high pressure to artificially fracture the reservoir rock in order to increase permeability and production. In some implementations, a pad, which is fracture fluids without proppants, is first pumped down the well until formation breakdown. Then, the fracturing fluid with proppants is pumped downhole to hold the fractures open after pumping stops. At the end of the fracture treatment, a clear fluid flush may be pumped down the well to flush the well of proppants.

In some instances, an initial treatment or minifracture may be performed before a production stimulation fracture treatment to calculate formation and fracture properties. In some implementations, the initial treatment may be an injection falloff test.

SUMMARY

A first aspect is directed to a method including determining a process zone stress for a subterranean zone intersected by a wellbore using a fracture analysis system and determining whether to perform a stimulation treatment to the subterranean zone based on the determined process zone stress.

A second aspect is directed to a method for determining whether to perform a stimulation treatment on a subterranean zone of a subterranean reservoir. The method may include performing a fracture injection falloff test on the subterranean zone and collecting well shut-in pressure data after cessation of the fracture injection falloff test. The method may also include determining process zone stress of the subterranean zone using the shut-in pressure data and determining whether to perform a stimulation treatment on the subterranean zone based on the process zone stress.

A third aspect may include a system for determining whether to perform a stimulation treatment to a subterranean zone based on an estimated profitability potential of the subterranean zone. The system may include a fracture control engine operable to control a fracture injection falloff test performed in a zone of a well and a fracture analysis engine operable to receive and process data from the fracture injection falloff test for determining a process zone stress. The fracture control engine may be operable to control a subsequent fracturing operation only if the process zone stress is below a threshold value.

One or more aspect may include one or more of the following features. Determining a process zone stress for a subterranean zone intersected by a wellbore may include performing a fracture injection falloff test, collecting data from the fracture injection falloff test, and determining the process zone stress using the collected data. Determining the process zone stress using the collected data may include determining an instantaneous shut-in pressure, determining a fracture closure pressure, and determining the process zone stress from the instantaneous shut-in pressure and fracture closure pressure. Determining a fracture closure pressure may include utilizing a graphical methodology to determine the fracture closure pressure. Utilizing a graphical methodology to determine the fracture closure pressure may include utilizing at least one of a G-function methodology, square-root-of-time methodology, and log-log plot methodology to determine fracture closure pressure. Determining a fracture closure pressure may include using a mechanical technique to determine the fracture closure pressure. Determining a process zone stress for a subterranean zone intersected by a wellbore may include determining a normalized process zone stress gradient for the subterranean zone. A stimulation treatment may be performed when the normalized process zone stress gradient is less than or equal to 0.12 psi/ft. Determining the process zone stress may include correlating historical production stimulation fracturing data of the well to determine process zone stress. Correlating historical production stimulation fracturing data of the well to determine process zone stress may include generating a history-match fracture model.

One or more aspects may also include one or more of the following features. Determining process zone stress of the subterranean zone using the shut-in pressure data may include determining a normalized process zone stress gradient. Determining process zone stress of the subterranean zone using the shut-in pressure data may include determining an instantaneous shut-in pressure, determining a closure pressure, and determining the process zone stress using the instantaneous shut-in pressure and closure pressure. Determining a closure pressure may include determining the closure pressure using a graphical methodology. Determining the closure pressure using a graphical methodology may include using a G-function methodology, a square-root-of-time methodology, or a log-log plot methodology to determine the closure pressure. Performing a fracture injection falloff test on the subterranean zone may include performing a diagnostic fracture injection test.

One or more aspects may also include one or more of the following features. The threshold value may be between 1,100 psi and 1,900 psi. The fracture analysis engine may be coupled to one or more sensors adapted to collect the data from the fracture injection falloff test. The fracture injection falloff test may be a diagnostic fracture injection test. The process zone stress may be a normalized process zone stress gradient. The threshold for the normalized process zone stress gradient may be 0.12 psi/ft.

The details of one or more implementations are set forth in the accompanying drawings and the description below. Other features, objects, and advantages will be apparent from the description and drawings, and from the claims.

DETAILED DESCRIPTION

Figure 1:
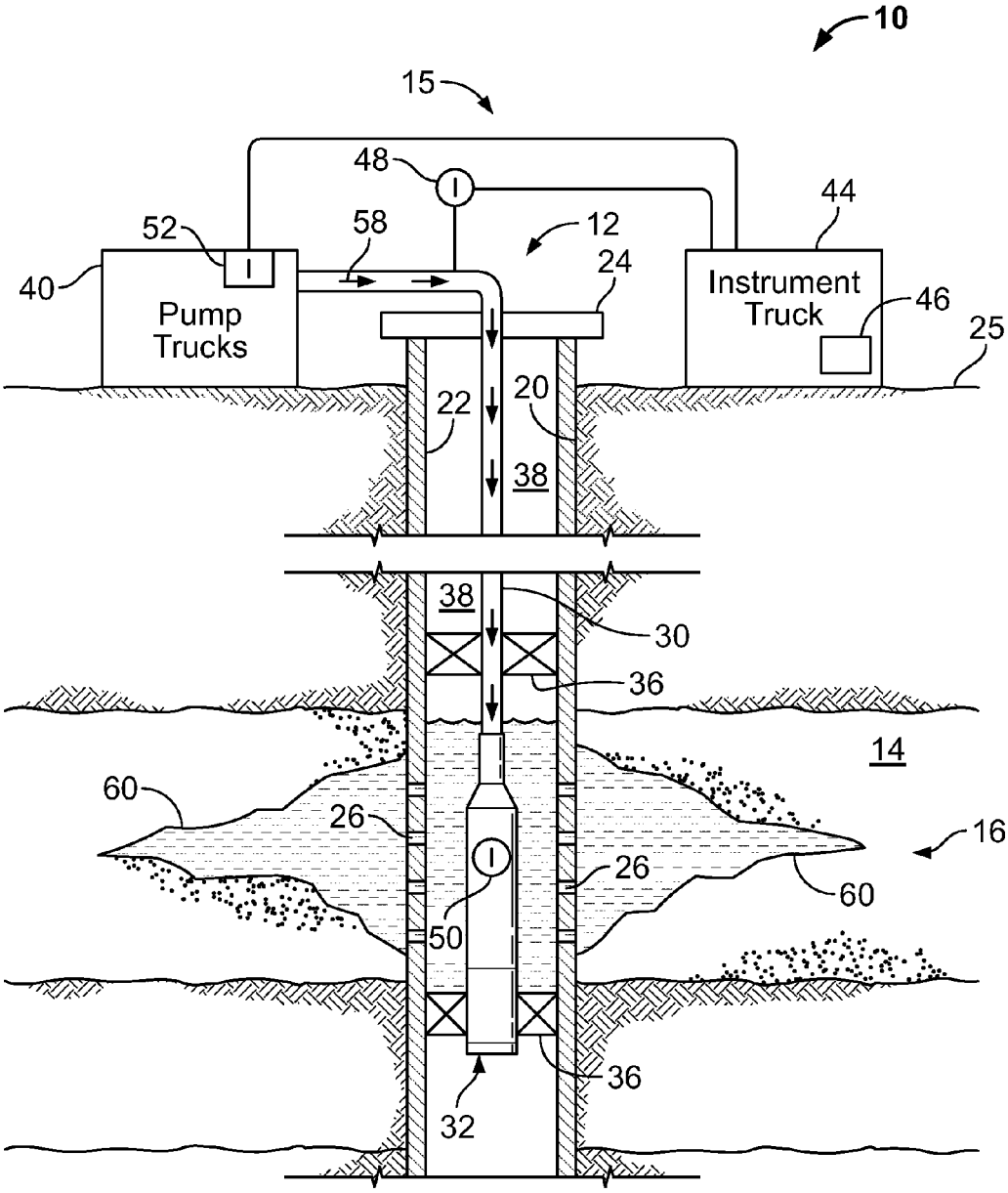
FIG. 1 illustrates one embodiment of a fracture treatment for a well.

FIG. 1 illustrates an example implementation of a fracture treatment 10 for a well 12. The well 12 may be an oil and gas well intersecting a reservoir 14. The reservoir 14 may be an underground formation of rock containing oil and/or gas. The reservoir 14 may include one or more zones, each accessed by a well 12 or otherwise. For example, a zone, such as zone 16, may be vertically or horizontally spaced in the reservoir 14. However, the reservoir 14 may include additional or fewer subterranean zones. The well 12 may in other embodiments, intersect other suitable types of reservoirs 14.

The fracture treatment 10 may include a production stimulation fracturing treatment or an initial fracture injection falloff test or other suitable treatment. The fracture injection falloff test may also be referred to as a mini fracture ("minifrac") test. An example fracture injection falloff test is a Diagnostic Fracture Injection Test ("DFIT") 15. In the course of an initial fracture injection falloff test, such as the DFIT, a fracture fluid without proppant is injected into a well to fracture a subterranean zone. In some instances, the fracture fluid may be water, a two percent KCL solution, or other suitable fluid. Other suitable tests may be used. For the purposes of this description, DFIT will be discussed, although it will be understood that the fracture injection falloff test is not limited to a DFIT, but, rather, is merely used as an example.

Referring to FIG. 1, the well 12 may include a well bore 20, casing 22, and well head 24. The well bore 20 may be a vertical bore, a horizontal bore, a slanted bore or other deviated bore. The well bore 20 may also include one or more laterals extending therefrom into the reservoir 14. The casing 22 may be cemented or otherwise suitably secured in the well bore 20. Perforations 26 may be formed in the casing 22 at the level of the reservoir 14 to allow oil, gas, and by-products to flow into the well 12 and be produced to the surface 25. Perforations 26 may be formed using shape charges, a perforating gun or otherwise.

For the DFIT 15, a work string 30 may be disposed in the well bore 20. The work string 30 may be coiled tubing, sectioned pipe, or other suitable tubing. A fracturing tool 32 may be coupled to an end of the work string 30. The fracturing tool 32 may include a SURGIFRAC or COBRA FRAC tool manufactured by Halliburton of 10200 Bellaire Blvd., Houston, Tex., or other suitable fracturing tool. Packers 36 may seal an annulus 38 of the well bore 20 above and below one or more zones (e.g., zone 16) of the reservoir 14. Packers 36 may be mechanical, fluid inflatable, or other suitable packers.

One or more pump trucks 40 may be coupled to the work string 30 at the surface 25. The pump trucks 40 pump fracture fluid 58, such as a fracturing fluid described above, down the work string 30 to perform the DFIT 15. The pump trucks 40 may include mobile vehicles, equipment such as skids or other suitable structures.

One or more instrument trucks 44 may also be provided at the surface 25. The instrument truck 44 may include a fracture control system 46 for monitoring and controlling the DFIT 15. The fracture control system 46 communicates with surface and/or subsurface instruments to monitor and control the DFIT 15. In some implementations, the fracture control system 46 may control the pump truck 40 and fluid valve to stop and start the DFIT. In some instances, the surface and subsurface instruments may include surface sensors 48, down-hole sensors 50, and pump controls 52.

Surface and down-hole sensors 48 and 50 may include pressure, rate, temperature, and/or other suitable sensors. Pump controls 52 may include controls for starting, stopping, and/or otherwise controlling pumping as well as controls for selecting and/or otherwise controlling fluids pumped during the DFIT 15. Surface and down-hole sensors 48 and 50 as well as pump controls 52 may communicate with the fracture control system 46 over wire-line, wireless, or other suitable links. For example, surface sensors 48 and pump controls 52 may communicate with the fracture control system 46 via a wire-line link while down-hole sensors 50 communicate wirelessly to a receiver at the surface 25 that is connected by a wire-line link to the fracture control system 46. In other instances, the down-hole sensors 50 may upon retrieval from the well 12 be directly or otherwise connected to fracture control system 46.

The instrument truck 44 may also include a fracture analysis system 47 operable to analyze data obtained from a minifrac test. The fracture analysis system 47 may collect and record various data types during a minifrac test and determine Process Zone Stress ("PZS") (sometimes referred to as "net pressure") to aid in determining whether a production stimulation fracturing treatment should be performed. Although the fracture analysis system 47 is shown as being included in the instrument truck 44, the fracture analysis system 47 may be located at another location at or remote from the well 12.

In operation, the fracturing tool 32 is coupled to the work string 30 and positioned in the well 12. The packers 36 are set to isolate one or more subterranean zones of the reservoir 14, such as zone 16. The pump trucks 40 pump fracture fluid 58 down the work string 30 to the fracturing tool 32. The fracture fluid 58 exits the fracturing tool 32 and creates a fracture 60 in the one or more subterranean zones 16. In the example shown, the fracture 60 is formed in the subterranean zone 64. However, a fracture 60 may be formed in additional zones. In a particular embodiment, a fracture fluid 58 may include a fluid pad pumped down the well 12 until breakdown of the formation in the one or more subterranean zones 16. The DFIT 15 may be otherwise suitably performed.

For example, in some instances, pumping rates during a DFIT 15 may be three to six barrels per minute (bpm). However, the pumping rates may vary based on estimates associated with the subterranean zone 16. For example, the material type and estimated properties (e.g., permeability) of the subterranean zone 16 and injection rate may affect the pumping rate. When breakdown of the subterranean zone 16 is achieved, the pumping rate may be maintained at a constant rate and variations to the pumping rate may be avoided. Once shut-in is achieved, disturbance of the well 12 may be avoided while the data is collected.

An example DFIT includes injecting a volume of fluid into the well at a desired fluid flow rate. In some instances, the injected fluid is fresh water that does not include proppant. Also, the volume of fluid injected is less than the fluid injected during a production stimulation fracture treatment. For example, a fluid volume of approximately 1,077 gallons injected into the well at a rate of approximately three bpm may be used. However, other fluid volumes at different rates may also be used.

A purpose of the DFIT 15 is to initiate a fracture in the subterranean zone and obtain data associated with the fracture. For example, instantaneous shut-in pressure ("ISIP") and fracture closure pressure may be obtained from the DFIT 15. Once the fluid is injected into the well, such as well 12, the well is shut in and pressure falloff within the well is measured. In instances where the well maintains a column of liquid, a pressure gauge may be placed at the surface to measure the changing pressures over the shut in period. In other instances, such as for wells that do not maintain a column of liquid, a pressure gauge may be located downhole in order to measure the pressure data. Pressure data may be measured at 0.01 psi increments. Other data may also be collected. For example, temperature, fluid injection rate, pump speed, time, seismic data, and/or other data may be collected. The collected data may be transmitted to the instrument truck 44 for recordation. The recorded data may be analyzed to determine, for instance, the ISIP and fracture closure pressure. When the ISIP and closure pressure is obtained by analyzing the DFIT data, the PZS may be obtained with the following equation: PZS=(ISIP−closure pressure).

In some instances, pressure data for determining ISIP is measured at the surface, such as with a sensor located at the surface 25. However, in other instances, the pressure data may be measured at the subterranean zone 16 with a pressure sensor disposed in the well 12 in or near the subterranean zone 16. Similarly, closure pressure may be determined as a pressure at the surface 25 or subterranean zone 16. Thus, when determining PZS, the ISIP and closure pressure used should be with reference to the same location, e.g., at the surface 25 or at the location of the subterranean zone 16. Converting a pressure measured at the surface 25 to the corresponding pressure existing at the subterranean zone 16 may be performed by adding hydrostatic head pressure at the depth of the subterranean zone 16 to the pressure measured at the surface 25.

Data collected by the fracture analysis system 47 from the DFIT 15 may be used to determine formation properties and residual fracture properties before the production stimulation fracture treatment. Thus, the DFIT 15 may be conducted to breakdown, i.e., form a fracture in, a formation, such as subterranean zone 16, and determine properties of the subterranean zone based on collected data. For example, data collected from a DFIT 15 may be used by and/or in connection with the fracture analysis system 47 to determine closure pressure of the generated fracture, ISIP, pore pressure, and an estimated permeability of the subterranean zone. Further, the fracture analysis system 47 may use the collected data to determine PZS as an indicator of the production potential of the subterranean zone 16. For example, the fracture analysis system 47 may determine these properties by analyzing pressure falloff data obtained during shut-in of the well 12. In some instances, collection of the data by the fracture analysis system 47 may be started prior to injection of fluid into the well 12. Also, in some implementations, data may be collected by the fracture analysis system 47 once every second from the beginning through the end of the DFIT.

The formation permeability is an estimate of the reservoir rock's ability to flow or transmit fluids. The PZS is a spatial variable that defines fracture tip effects and their influence on hydraulic fracture stimulation. The PZS associated with a reservoir zone or portion thereof may be an indicator of the reservoir zone's resistance to fracture. Thus, PZS may be used to determine the productivity potential of the subterranean zone or portion thereof in which the initial treatment was performed. Further, PZS may also be used to determine whether the costly production stimulation fracture treatment should be performed.

PZS may be an indicator of a reservoir zone's resistance to initiate and propagate a fracture and, thus, the productivity potential of the reservoir zone. PZS may not be an absolute measure of the productivity potential of a reservoir zone since tip effects, which are cumulatively referred to as PZS, may vary during fracturing. For example, the PZS value may vary depending on whether a fracture tip of a fracture (such as fracture 60) is moving or stationary at each point along the perimeter at that point. However, tip effects associated with PZS may be separated from contributions due to perforations and near wellbore effects. Further, even though PZS can vary, the initially determined PZS value may be used as an indicator of the productivity potential of the subterranean zone, since PZS generally increases during the course of a fracture treatment conducted with or without proppant. Moreover, the PZS value determined as a result of a DFIT may be reliably used as an indicator of the reservoir zone's productivity potential since the PZS is generally higher during the production stimulation fracture treatment. Accordingly, the PZS obtained during the DFIT allows one to determine whether a subterranean zone will be a good producer of reservoir fluids and, thus, whether to perform a production stimulation fracturing treatment. Therefore, performing a DFIT and obtaining the PZS can reduce costs where the PZS indicates a poor producing potential.

Additionally, PZS is independent of reservoir type. That is, a PZS of a certain value is indicative of poor productivity regardless as to the material type forming the reservoir zone or portion thereof. Rather, PZS includes effects of fluid lag, intact rock strength, and other non-linear stress dissipations around a fracture tip, each of which restrict growth of the fracture in the reservoir zone. Thus, PZS is not related to only one property.

With and/or in connection with the fracture analysis system 47, the closure pressure may be determined in any number of ways. For example, the fracture analysis system 47 may be used to determine closure pressure according to one or more graphical methods. In some instances, the fracture analysis system 47 may be operable to generate the plots shown in FIGS. 2, 3, and 4. Still further the fracture analysis system 47 may be operable to determine closure pressure based on the plots shown in FIGS. 2, 3, and 4 and/or the methodologies associated with the FIGS. 2, 3, and 4. Thus, the fracture analysis system 47 may be operable to determine closure pressure using example graphical techniques such as a standard Cartesian falloff plot, a square-root-of-time plot, a semilog plot, a log-log plot, and a G-function plot.

In addition to graphical techniques, mechanical techniques may be used to determine closure pressure. Example mechanical techniques may include a pulse test and the use of tiltmeters.

Determining closure pressure using some example graphical techniques (interchangeable referred to as "graphical methodologies" or "graphical methods") is described, although, as explained, other methodologies may be used. According to some implementations, the fracture analysis system 47 may be used to determine closure pressure according to one or more methods. For example, the fracture analysis system 47 may be operable to generate the plots shown in FIGS. 2, 3, and 4. Still further the fracture analysis system 47 may be operable to determine closure pressure based on the plots shown in FIGS. 2, 3, and 4 and/or the methodologies associated with the FIGS. 2, 3, and 4.

Figure 2:
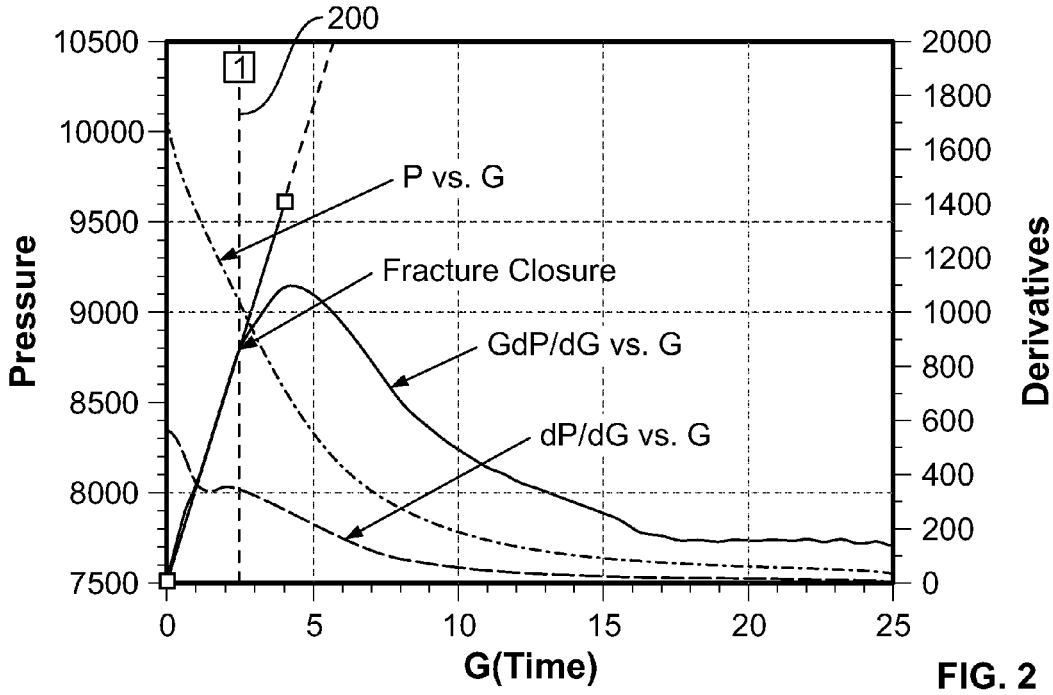
FIG. 2 is an example G-function plot for determining closure pressure.

Referring to the G-function plot shown in FIG. 2, an expected signature of the G-function semilog derivative is a straight line through the origin, e.g., zero G-function and zero derivative. Closure pressure is identified by the departure of the semi-log derivative of pressure with respect to G-function ($G\delta p/\delta G$) from the straight line through the origin. Particularly, closure pressure is indicated by the dashed vertical line 200.

The data collected from the DFIT 15 and analysis results therefrom may be used to determine whether a subsequent fracture treatment should be performed and, if so, aid in the design of a subsequent fracture treatment. Thus, the fracture treatment 10 may also include a production stimulation fracture treatment, a follow-on fracture treatment, a final fracture treatment, or other suitable fracture treatment (collectively referred to as "production stimulation fracture treatment"). A production stimulation fracture treatment may include injecting a fluid into the well 12 along with one or more additives, such as a gel, acid, proppant, and/or other desired materials.

Figure 3:
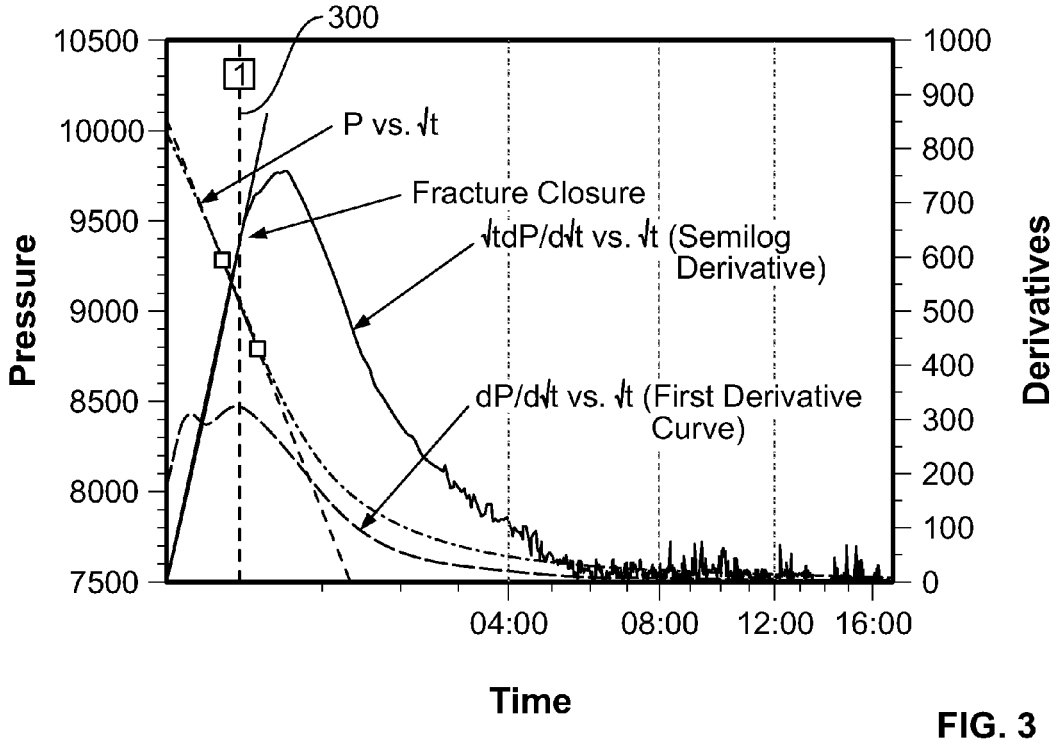
FIG. 3 is an example square-root-of-time plot for determining closure pressure.

FIG. 3 shows an example square-root-of-time plot ("sqrt (t)") for determining closure pressure. In using the sqrt(t) method, closure pressure is indicated by an inflection point on the pressure v. square-root-of-time plot ("P v. sqrt(t)"). The inflection point may be located by plotting the first derivative of pressure versus sqrt(t) and locating the point of maximum amplitude of derivative. As shown in FIG. 3, the dashed vertical line intersects the pressure versus sqrt(t) plot at the point of fracture closure. The point of fracture closure is verified using a semilog derivative of the P v. sqrt(t) curve. The fracture closure point falls at the point on the semilog derivative curve where this curve begins to deviate from the straight portion of this curve. The fracture closure point satisfies both of the criteria described above. Dashed vertical line 300 indicates closure pressure as determined using the G-function method.

Figure 4:
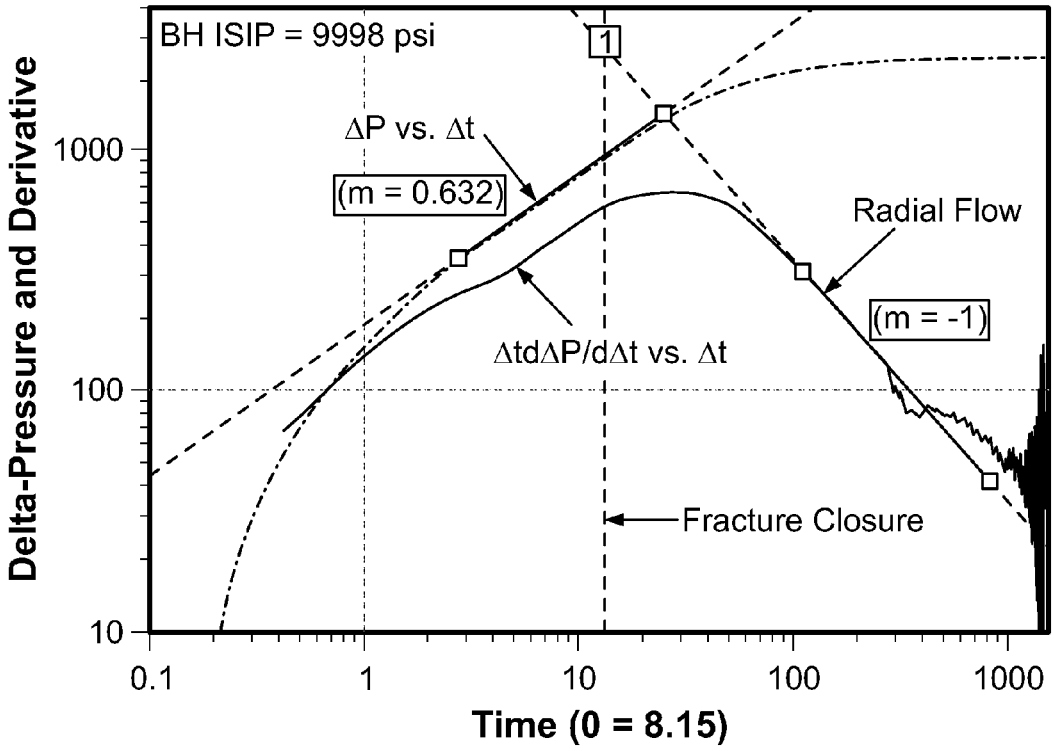
FIG. 4 is an example log-log plot for determining closure pressure.

A further graphical method is described with respect to FIG. 4. FIG. 4 shows a log-log plot for determining closure pressure. Included in the plot is a pressure difference curve ($\Delta P$ v. $\Delta t$) and the dashed curve is a semilog derivative with respect to shut-in time. In many cases, the pressure difference curve and the semilog derivative curve are parallel in the time portion immediately before fracture closure. The slope of the parallel lines is indicative of the flow regime established during leakoff before fracture closure. Separation of the two parallel lines identifies closure pressure. Particularly, closure pressure is indicated by the point where the slope of the semilog derivative plot changes slope from positive to negative.

Various pressure transient analysis software packages are available to determine closure pressure based on the data obtained from the DFIT 15. For example, Pumping Diagnostic Analysis Toolkit (PDAT) computer software may be used to perform one or more of the graphical methodologies to determine closure pressure. PDAT is a software package used to analyze minifrac pumping data and is a proprietary software package developed and used by Halliburton of 10200 Bellaire Blvd., Houston, Tex. However, any other software program capable of analyzing minifrac data to determine closure pressure may be used.

Figure 5:
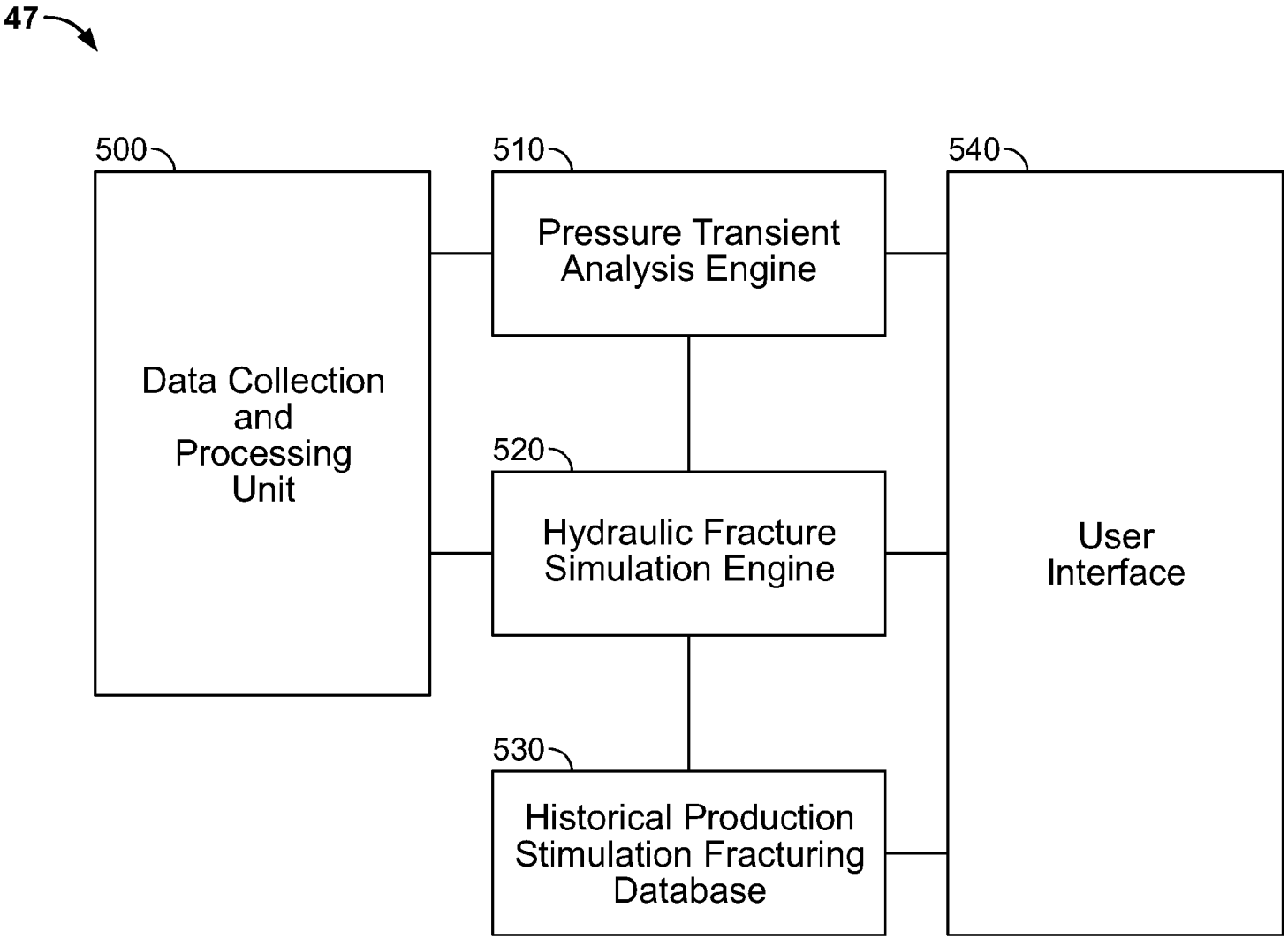
FIG. 5 shows a schematic of an example minifracture analysis system.

FIG. 5 schematically shows an example of the fracture analysis system 47 that may utilize one or more computer programs, including pressure transient analysis software and hydraulic fracture simulation software, to analyze received data and determine one or more pieces of information related to a fracture treatment, such as a DFIT 15. For example, the fracture analysis system 47 may be used to determine closure pressure and/or PZS.

One or more of the fracture control system 46 or the fracture analysis system 47 may be implemented as an integrated computer system such as a personal computer, laptop, or other stand-alone system. In other embodiments, the fracture analysis system 47 may be implemented as a distributed computer system with elements of the fracture analysis system 47 connected locally and/or remotely by a computer or other communication network. Also, the fracture control system 46 may be implemented as a distributed computer system having elements connected locally and/or remotely by a computer or other communication network. The fracture control system 46 and the fracture analysis system 47 may include any processors or set of processors that execute instructions and manipulate data to perform the operations such as, for example, a central processing unit (CPU), a blade, an application specific integrated circuit (ASIC), or a field-programmable gate array (FPGA). Processing may be controlled by logic which may comprise software and/or hardware instructions. The software may comprise a computer readable program coded and embedded on a computer readable medium for performing the methods, processes and operations of the respective engines. The fracture control system 46 and the fracture analysis system 47 may be operable to receive, process, store, analyze, and output reservoir-related data. For example, the reservoir-related data may include fracturing-related data, such as fracture planning, simulation, stimulation, and analysis data. Further, the fracture control system 46 and the fracture analysis system 47 may be integrated or partially integrated and/or share one or more components and/or process. Still further, the fracture control system 46 and the fracture analysis system 47 may be stand-alone systems.

In some implementations, the fracture analysis system 47 may include a data collection and processing unit 500, a pressure transient analysis engine 510, a hydraulic fracture simulation engine 520, a historical production stimulation fracturing database 530, and a user interface 540. The fracture analysis system 47 may and/or components of the fracture analysis system 47 may include additional, different, or other suitable components.

Data collection and processing unit 500 receives and/or communicates signals to and from surface and down-hole sensors 48 and 50 as well as pump controls 52. The data represent, for example, physical conditions of the well 12, the reservoir 14, and/or the fracture treatment. The data collection and processing unit 500 may correlate received signals to a corresponding measured value, filter the data, fill in missing data and/or calculate data derivatives used by one or more of the pressure transient analysis engine 510 and/or the hydraulic fracture simulation engine 520. The data collection and processing unit 500 may include data input/output (I/O) and a database or other persistent or non-persistent storage.

The pressure transient analysis engine 510 and hydraulic fracture simulation engine 520 may each be coupled to the data collection and processing unit 500 and the user interface 540. Accordingly, each may access data collected and/or calculated and each may be accessed by an operator or other user via the user interface 540. The hydraulic fracture simulation engine 520 may also be coupled to the historical production stimulation fracturing database 530. The user interface 540 may comprise a graphical interface, a text based interface or other suitable interface. The user interface 540 may be used to interact with the pressure transient and analysis engine 510, the hydraulic fracture simulation engine 520, and/or the historical production stimulation fracturing database 530 as well as to view output information respectively therefrom.

In some implementations, the pressure transient and analysis engine 510 includes PDAT. However, the pressure transient and analysis engine 510 may include other or different software programs for analyzing the collected DFIT data to determine PZS. The pressure transient and analysis engine 510 utilizes the data from the DFIT stored or otherwise maintained in the data collection and processing unit 500. Particularly the pressure transient and analysis engine 510 uses the collected data from the DFIT to determine ISIP and closure pressure and, ultimately, determine the PZS. In determining the closure pressure, the pressure transient and analysis engine 510 may use one or more of the methodologies described above, such as the Cartesian falloff plot, the square-root-of-time plot, the semi-log plot, the log-log plot, and/or the G-function plot. Examples of some of these methodologies are discussed above with respect to FIGS. 2, 3, and 4.

In some instances, the pressure transient and analysis engine 510 determines PZS according to the following relationship: PZS=ISIP−closure pressure. The resulting PZS value may be used to determine the production potential of the subterranean zone and, thus, whether a production stimulation fracture treatment should be performed. In some instances, a PZS value of 1,900 psi or above may be an indication of a subterranean zone with poor production potential. In other instances, a PZS value of 1,400-1,500 psi or greater may be deemed a poor risk and represent a poor production potential. Further, a PZS value of 1,100 psi or lower may be determined to be a good indicator of production. Thus, a production stimulation fracture treatment may be applied and/or only applied to a subterranean zone having a PZS value of 1,100 psi or less. In those instances where the PZS value exceeds a value indicating a poor production potential, the production stimulation fracture treatment may be avoided, i.e., not performed. Still further, a production stimulation fracturing treatment may not be performed on a subterranean zone where a PZS indicating a poor production potential value is determined at any location along the subterranean zone. Determination of PZS as well as one or more other aspects for performing the DFIT 15, collecting and/or analyzing data from the DFIT 15, and any other aspect related to the determination of whether to perform a production stimulation fracture treatment (including the design thereof) may be performed automatically or otherwise suitable made. For example, in some instances, the PZS may be determined automatically by the fracture analysis system 47 while also being stored and/or displayed for operator review.

In other implementations, a normalized value of PZS, referred to hereinafter as "normalized process zone stress gradient" or "normalized PZS gradient", may be used. The normalized PZS gradient may be determined using the determined PZS value and the subterranean depth at which the subterranean zone is located. In such cases, the determined PZS value is divided by the depth of the subterranean zone (understanding that this is the depth or approximate depth at which the fracture formed during the DFIT). Thus, a PZS that may otherwise be considered indicative of a poor production potential, the normalized PZS gradient may indicate a profitable producing well. In some instances, a normalized PZS gradient value at or above 0.12 psi/ft. may be indicative of a well having a poor production potential, and, thus, a production stimulation fracture treatment may be avoided, i.e., not performed. In other instances, a subterranean zone having a normalized PZS gradient value at or below 0.12 psi/ft. may be deemed a good risk and having an acceptable production potential. In such instances, a production stimulation fracture treatment may be performed.

In still other implementations, a normalized PZS gradient value may be used in connection with the determined PZS value. A PZS for a subterranean zone may be determined to be 1,400 psi, which may be determined to have a poor production potential. Thus, a production stimulation fracture treatment may be avoided based on this PZS value. However, by normalizing the PZS value based on the depth of the subterranean zone (at a depth of approximately 15,000 ft. in this example), the resulting normalized PZS gradient value is 0.09 psi/ft. (1,400 psi/15,000 ft.=0.09 psi/ft.). As 0.09 psi/ft. is less than 0.12 psi/ft., this subterranean zone is determined to have good production potential.

For subterranean zone having a good production potential based on the determined PZS and/or normalized PZS gradient, the properties of the subterranean zone determined from the DFIT data (e.g., permeability and pore pressure) may be sent to the hydraulic fracture simulation engine 520. The hydraulic fracture simulation engine 520 may include fracture modeling software that may be used to design and/or model a production stimulation fracture treatment. In some instances, the hydraulic fracture simulation engine 520 may include GOHFER® produced by Barree & Associates, LLC of 7112 W Jefferson Ave, Suite 106, Lakewood, Colo. However, the hydraulic fracture simulation engine 520 may include other or different fracture design software tools, packages, or programs for designing the production stimulation fracturing treatment.

In other implementations, the PZS value may be determined using historical production stimulation fracturing data of a well, such as well 12. Historical production stimulation fracturing data includes data obtained from a production stimulation fracturing treatment, such as a fracturing treatment performed for the purposes of increasing or otherwise enhancing production from the well, such as well 12. The historical production stimulation fracturing data may be located in the historical production stimulation fracturing database 530. The historical production stimulation fracturing data may be fed into the hydraulic fracture simulation engine 520, such as GOHFER, and obtain a PZS estimate using the historical production stimulation fracturing data. The historical production stimulation fracturing data may include, for example, log data, pressure data, injection rate data, and proppant concentration data. This PZS estimate may be in a similar manner as the PZS determined from the DFIT data.

For a well intersecting multiple subterranean zones that have a potential for producing subterranean fluids, in some implementations, the lowest subterranean zone may be isolated and a DFIT thereon. If the determined PZS for this subterranean zone shows a poor producing potential, the next subterranean zone above the first subterranean zone may be isolated and analyzed. That is, a DFIT may be performed on the next subterranean zone and a PZS obtained. A production stimulation fracture treatment may be performed or not performed based on the determined PZS value. The next-above subterranean zone may then be analyzed, and so forth.

Figure 6:
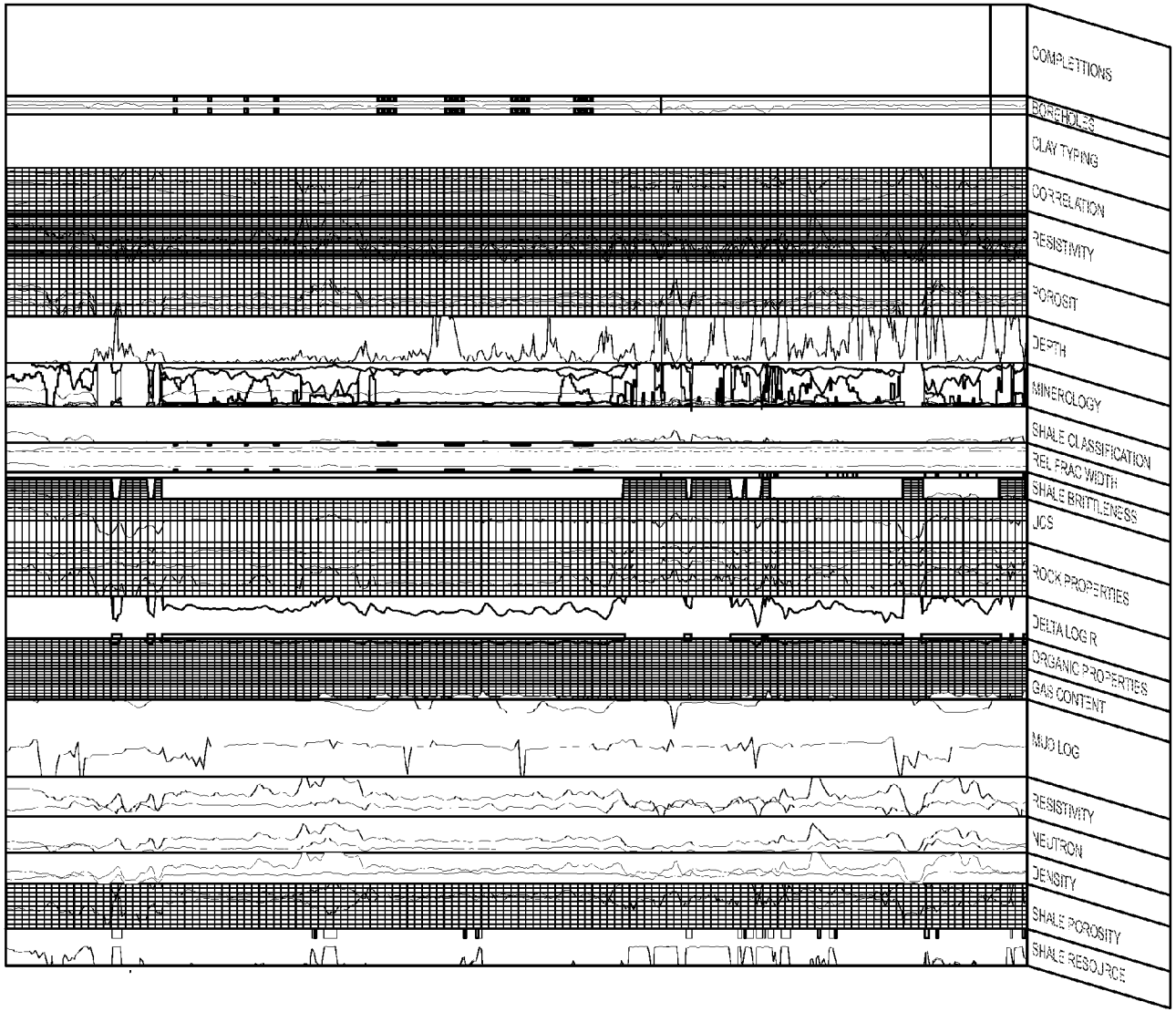
FIG. 6 is an example Shalelog™ of a subterranean zone.
Figure 7:
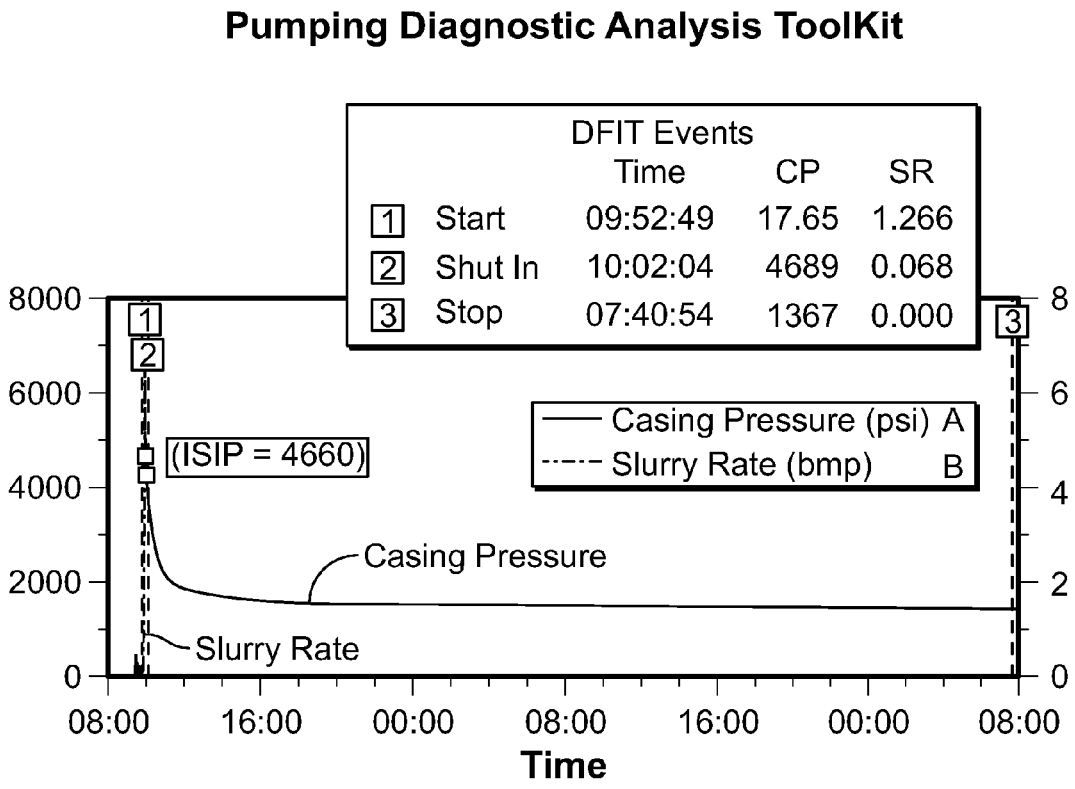
FIG. 7 is an example DFIT treatment plot.

Examples are now described with reference to FIGS. 6-15. Example 1 is described with reference to FIGS. 6-12. FIG. 6 shows a ShaleLog™ of an example subterranean zone formed from shale. The shale is intersected by a well. Perforations formed in the shale are located at approximately 5,960 to 6,018 ft. A DFIT was performed in this zone. The treatment plot is shown in FIG. 7. The DFIT consisted of approximately 1,077 gallons of fresh water injected at an average rate of approximately 3 bpm. The ISIP obtained was 7,261 psi, which resulted in a fracture gradient of 1.22 psi/ft. The falloff data was collected for approximately 45 hours and 40 minutes. The pressure falloff data was analyzed using the log-log plot methodology described above and in SPE 107877. The log-log plot is shown in FIG. 8.

Figure 8:
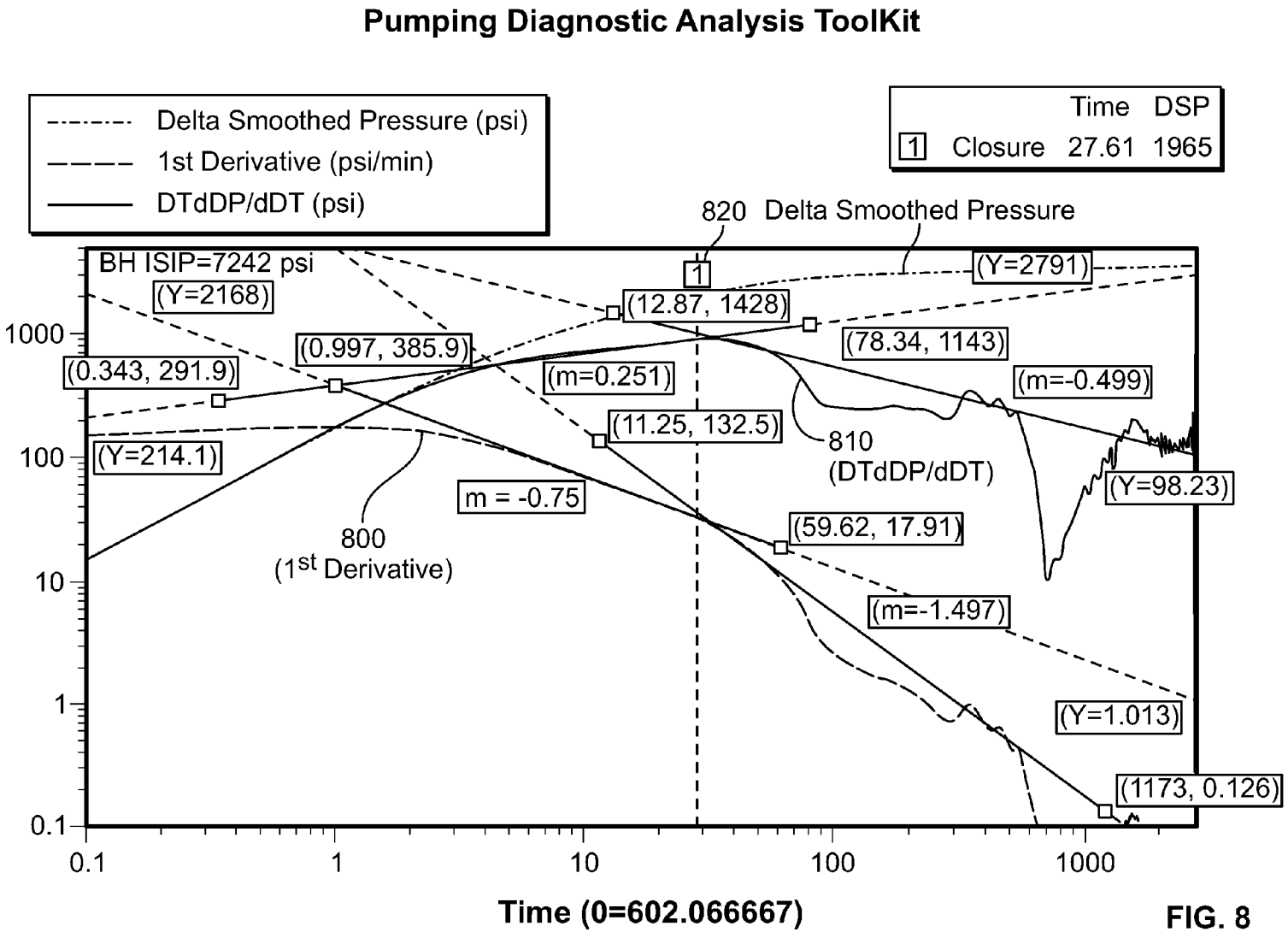
FIG. 8 is a log-log plot for determining closure pressure of an example DFIT.

Referring to FIG. 8, the first derivative curve 800 in the plot has a portion with a negative ¾slope (m=−0.75). A semilog derivative curve 810 includes a portion having a positive slope of approximately one-quarter (m=+0.251) in the prior to closure pressure 820, indicating bilinear flow before closure pressure 820. Closure pressure 820 is indicated by the change in slope from positive to negative in the semilog derivative curve 810. Closure pressure 820 is estimated to be 5,270 psi (0.88 psi/ft). After fracture closure indicated by 820, the first derivative curve 800 shows negative ½slope (m=−1.497) and the semilog derivative curve 810 shows a negative one-half slope (m=−0.499) indicating that pseudo-linear flow was observed during shut-in.

Figure 9:
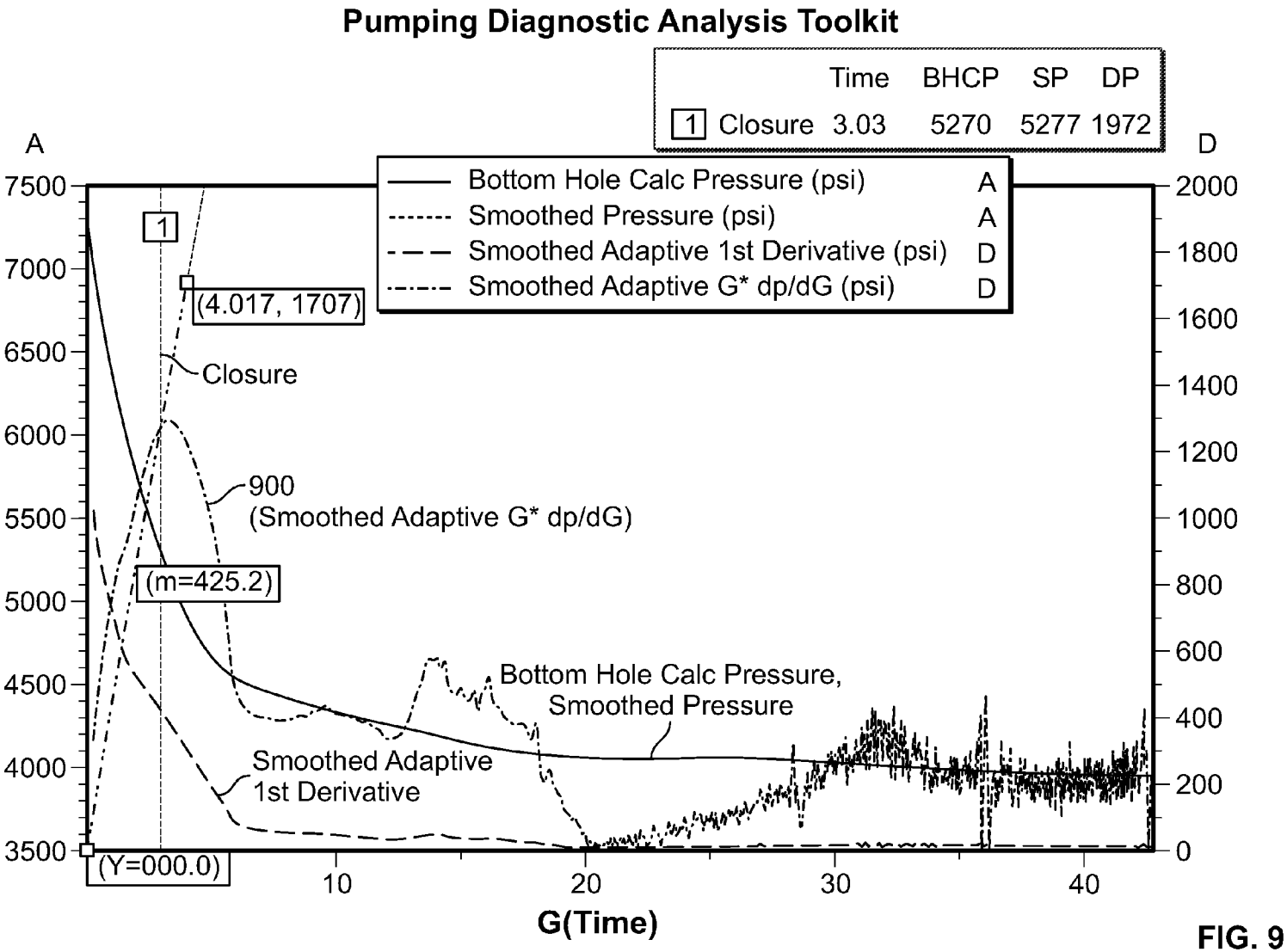
FIG. 9 is another example G-function plot.

In FIG. 9, the G-function derivative analysis plot 900 shows pressure-dependent type leakoff during shut-in. A hump associated with fissure opening pressure is very shallow, and, consequently, it is difficult to identify a unique fissure opening pressure. Closure pressure is estimated to be 5,270 psi. This suggests that the pressure change or "delta P" between the fissure opening pressure and closure pressure is minimal. Noise observed in the plot is caused by bad data scatter observed during shut-in.

Using the relationship explained above, the PZS was estimated to be approximately 1,990 psi (PZS=7,261 psi−5,270 psi=1991 psi). This methodology may also be applied to subterranean zones formed from shale, subterranean coal, as well as to other reservoirs and subterranean zones. If the PZS is determined to be above a threshold value, a subsequent production stimulation fracture treatment may be avoided. For example, a threshold PZS value may be selected to be 1,100 psi, and this determined PZS stress is above the threshold. Consequently, a subsequent production stimulation fracture treatment may not be performed.

Figure 10:
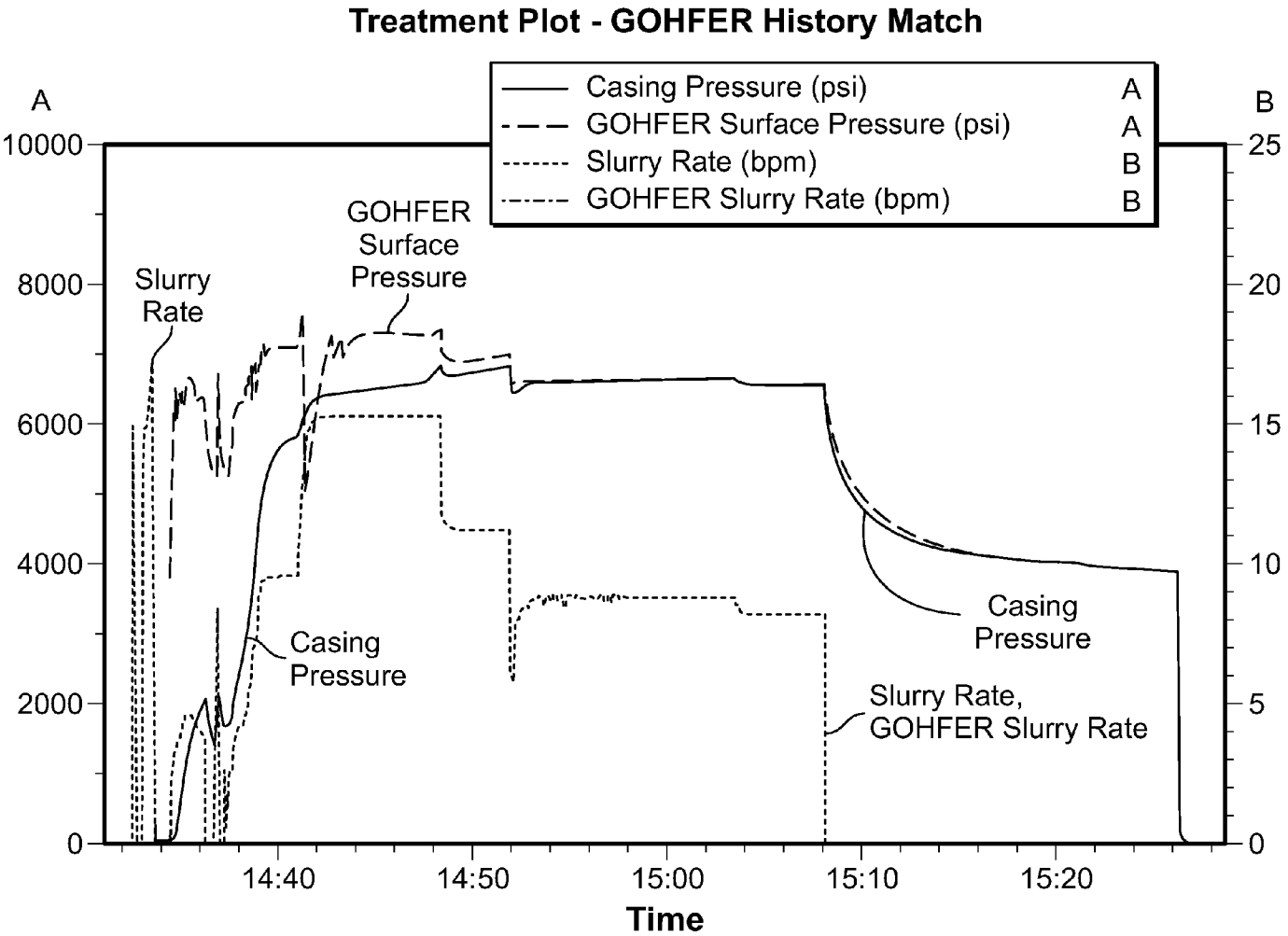
FIG. 10 is an example history match plot of a subterranean zone.

FIG. 10 shows a history match of a subsequent fracturing treatment (performed subsequent to the fracture injection falloff test) made to the shale. The history match was made using GOHFER. The fracturing treatment was aborted without pumping any proppant because the treating pressure was close to the maximum treating pressure of 7,000 psi. In order to obtain the GOHFER match, the PZS used in the model was increased to approximately 3,200 psi. This value exceeds that obtained from the DFIT (i.e., approximately 1,990 psi), which confirms that the PZS estimated from a fracture injection falloff test is a good starting point and likely the minimum that can be expected and can vary during injection of the fracture fluid, such as fracture fluid 58. If the PZS determined from a DFIT is high, one can expect that the actual PZS in the formation would be at least equal to or higher that this value.

It is noted that, although PZS was used in the analysis, the same result may be obtained by using a normalized PZS gradient value. For example, if an average depth of the subterranean zone is used ((5,960 ft.+6,018 ft.)/2=5,989 ft.), the normalized PZS gradient is 0.33 psi/ft., which is greater than 0.12 psi/ft.

Figure 11:
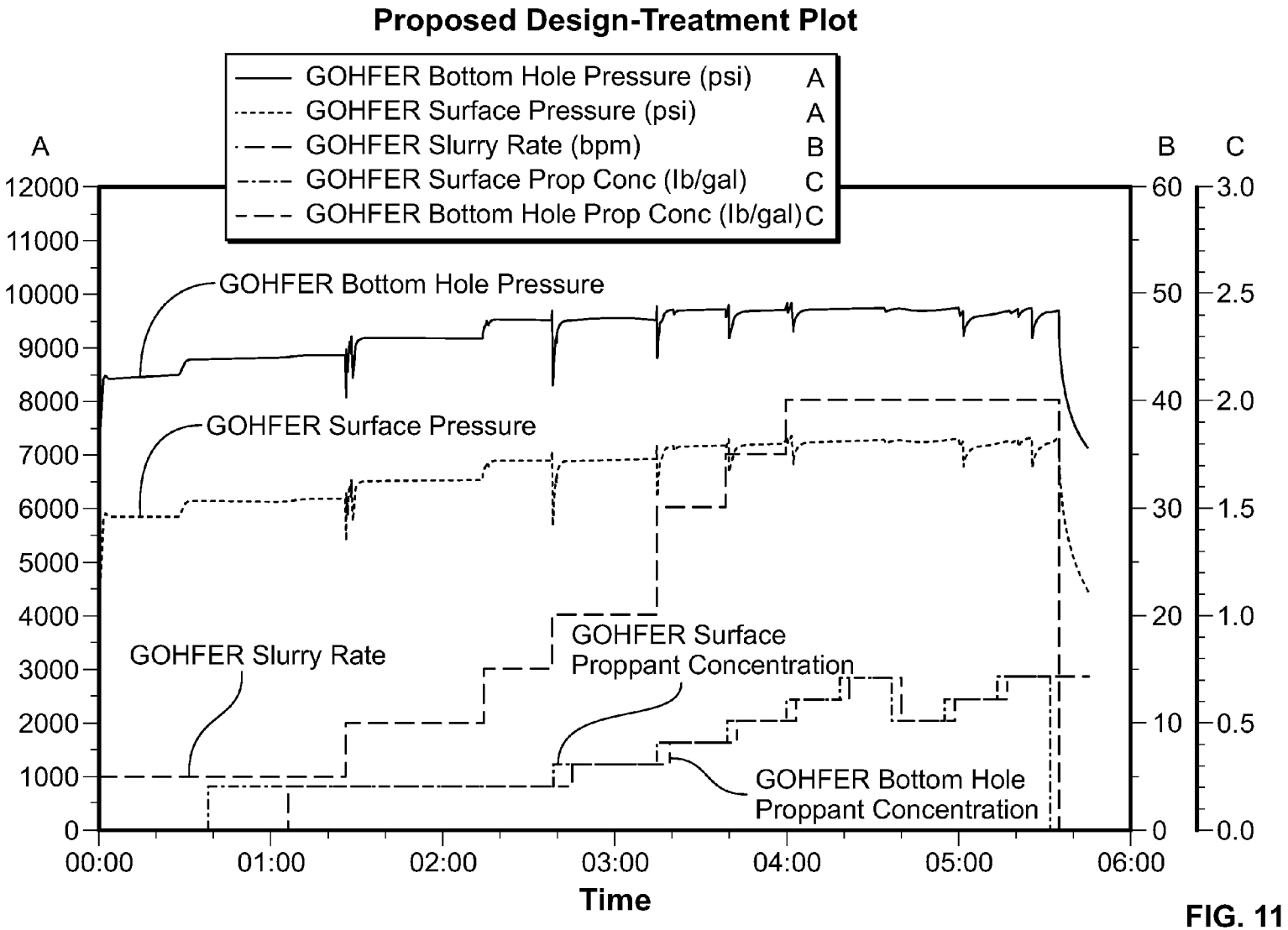
FIG. 11 is an example plot of a proposed fracturing treatment design.

To verify this analysis, a calibrated pre-fracturing model was created using GOHFER and used to model a design for a second fracturing treatment. The pre-fracture model showed that, unless the high PZS is mitigated, the treating pressure during the second fracturing treatment would exceed the maximum treating pressure of 7,000 psi. The proposed design for the second fracturing treatment made using the GOHFER model is shown in FIG. 11.

Figure 12:
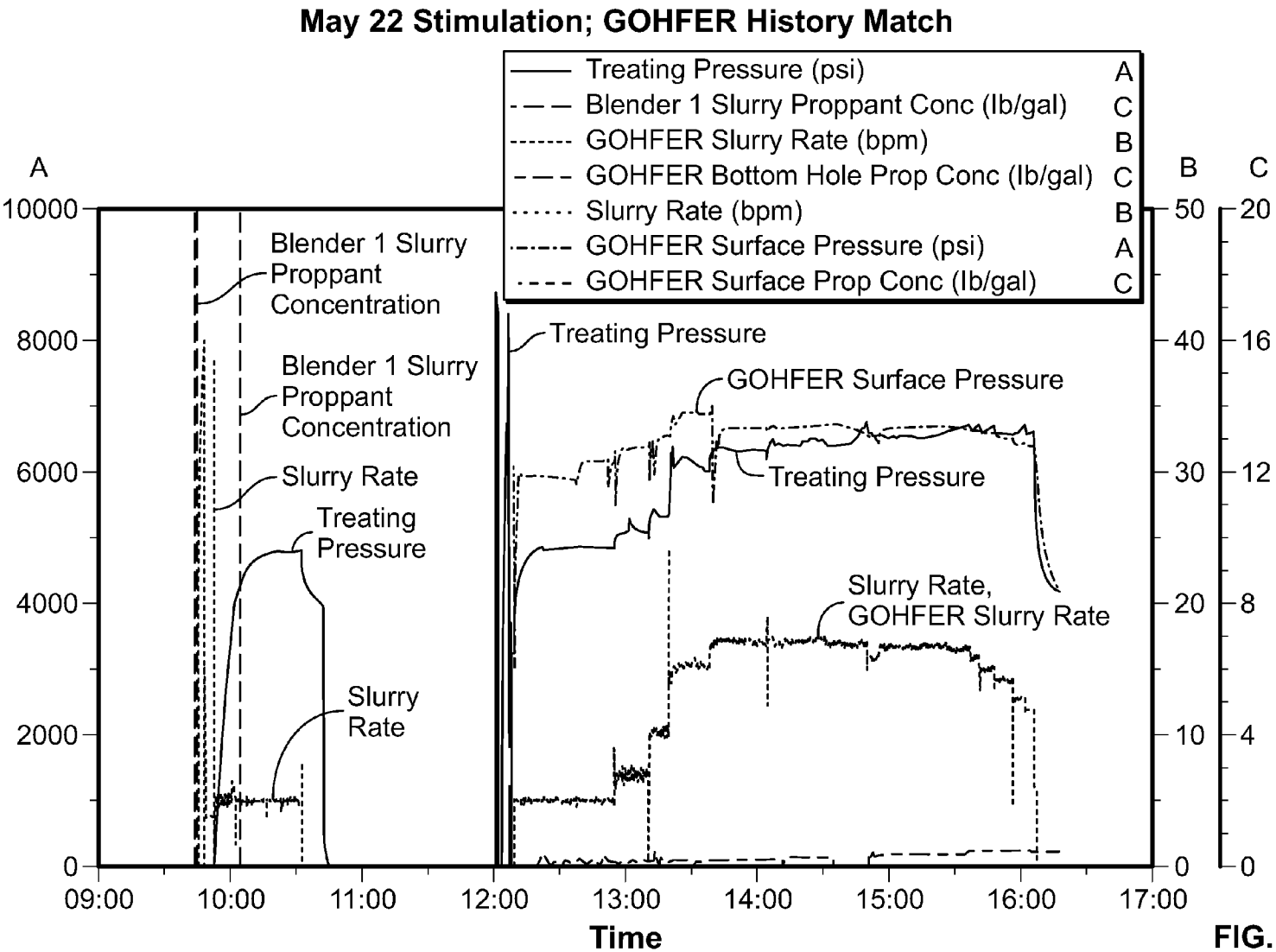
FIG. 12 is an example history match plot of a fracturing treatment.

The second fracturing treatment was also cut short due to the treating pressure approaching the maximum treating pressure, confirming the results of the pre-fracturing model. The GOHFER history match of the second fracturing treatment is shown in FIG. 12. The PZS value used in the model remained the same, approximately 3,200 psi., as identified in the history match of the first fracturing treatment. The correspondence of these values confirms that the high PZS estimated from the DFIT and later confirmed by the GOHFER fracture model for this zone is valid. It is also noted that, the production from the shale in the instant subterranean zone was low. As a result, the well intersecting this subterranean zone was temporarily plugged and abandoned.

Figure 13A:
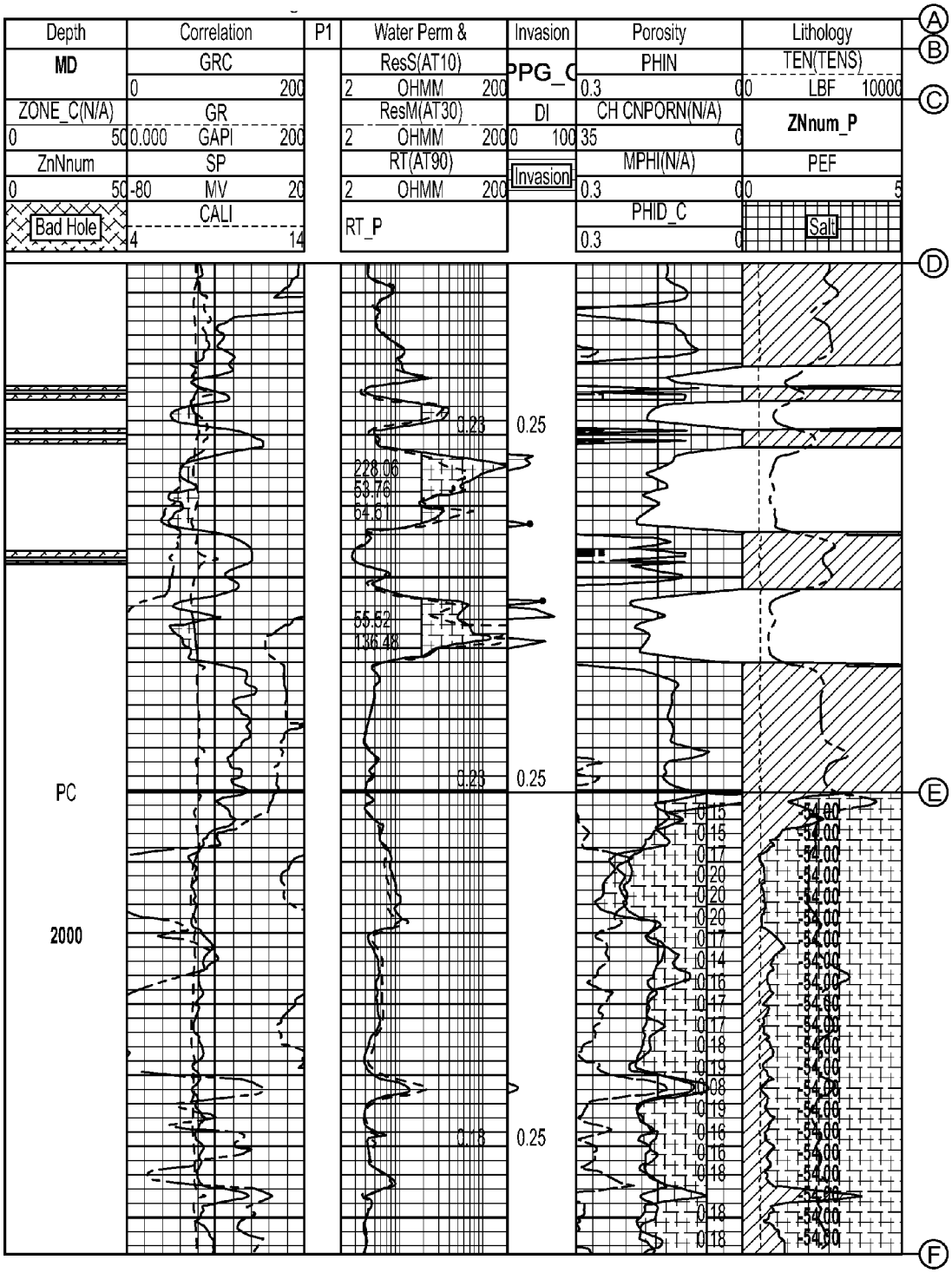
FIGS. 13A-B show another example well log indicating coal seams intersected by a well.
Figure 13B:
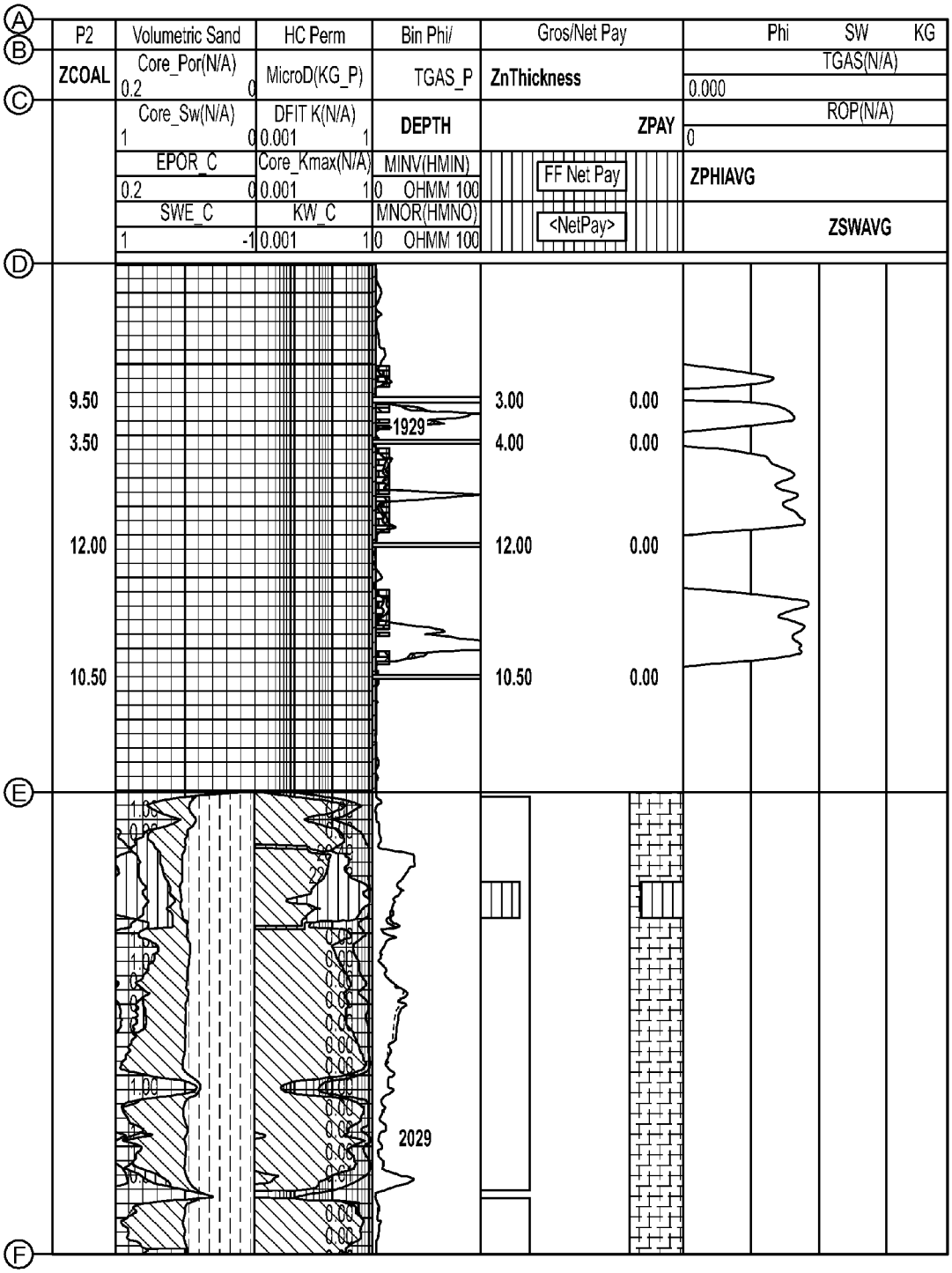
Figure 14:
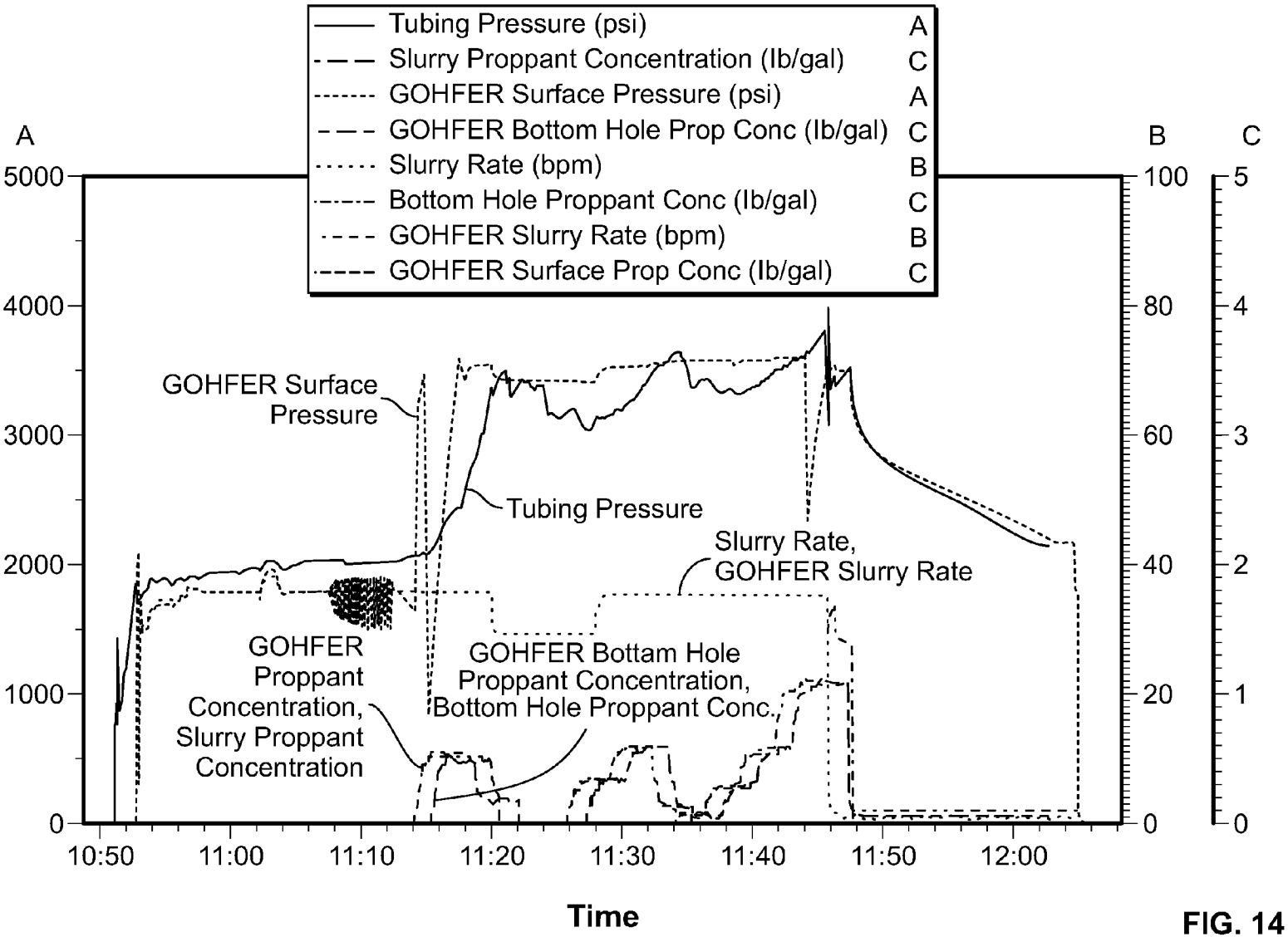
FIG. 14 is another example history match plot.
Figure 15:
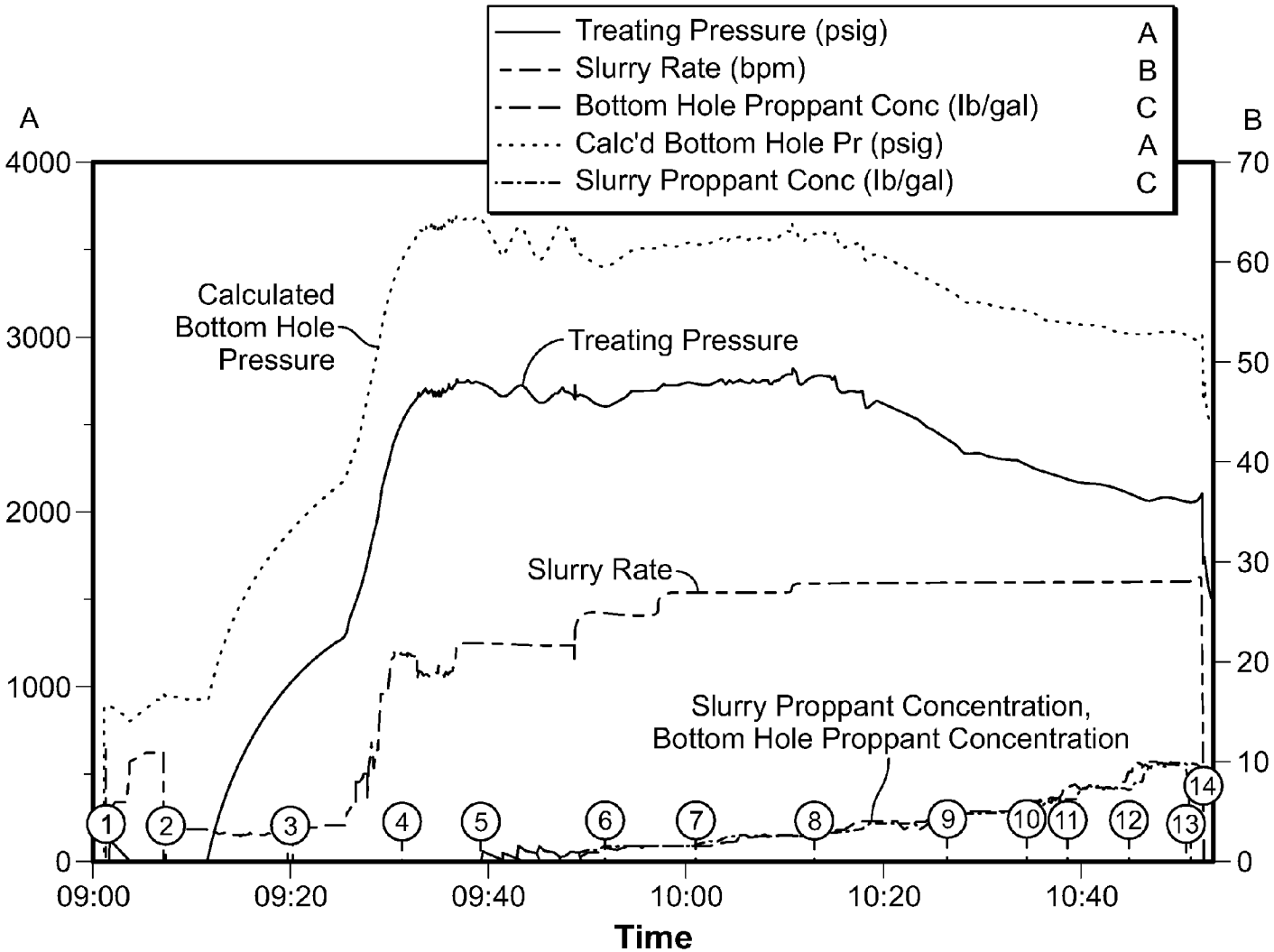
FIG. 15 is a treatment plot for an example stimulation treatment.

A second example is described with reference to FIGS. 13-15. The second example involves a well that intersects a subterranean zone formed from subterranean coal ("coal seam"), referred to as the "intersecting well". A type log of the coal seams intersected by the intersecting well is shown in FIGS. 13A-B. The perforations in the target coal seams are located at the following depths: 1922 ft., 1927-1928 ft., 1935-1942 ft., 1953-1955 ft., and 1955-1960 ft. The stimulation in these coal seams were cut short due to the treating pressure approaching the maximum limit. Although a DFIT was not performed in the intersecting well, a DFIT was performed in an offset well. The DFIT data showed that the offset well exhibited a moderately high PZS value of approximately 500 psi. The DFIT data from the offset well was used to perform a history match using GOHFER in order to estimate a PZS value for the intersecting well. This data is illustrated in FIG. 14. The history match resulted in a PZS value of 2250 psi and a normalized PZS gradient value of 1.16, both of which are extremely high.

Although the PZS and normalized PZS gradient values were high, the well was re-stimulated. A treatment plot from the additional stimulation treatment is shown in FIG. 15. While the additional stimulation treatment was successful, the resulting production from the intersecting well was very poor. Consequently, the history match determined using the DFIT data from the offset well confirmed that these coal seams have a much higher PZS and correspondingly poor production.

In other implementations, an approximate PZS value for which a fracture injection falloff test was not conducted may be obtained. For example, in some cases the reservoir zone data and historical production stimulation fracturing data may be used to generate a history match fracture model using a fracture modeling software program. In some instances, the fracture model may be prepared using GOHFER. The fracture model can include determination of an approximate PZS value for the subterranean zone. The estimated PZS value obtained using the fracture modeling software may be used in a manner similar to the PZS value obtained using DFIT data. That is, if the PZS value is above a threshold value, a stimulation treatment to the subterranean zone may be avoided.

Figure 16:
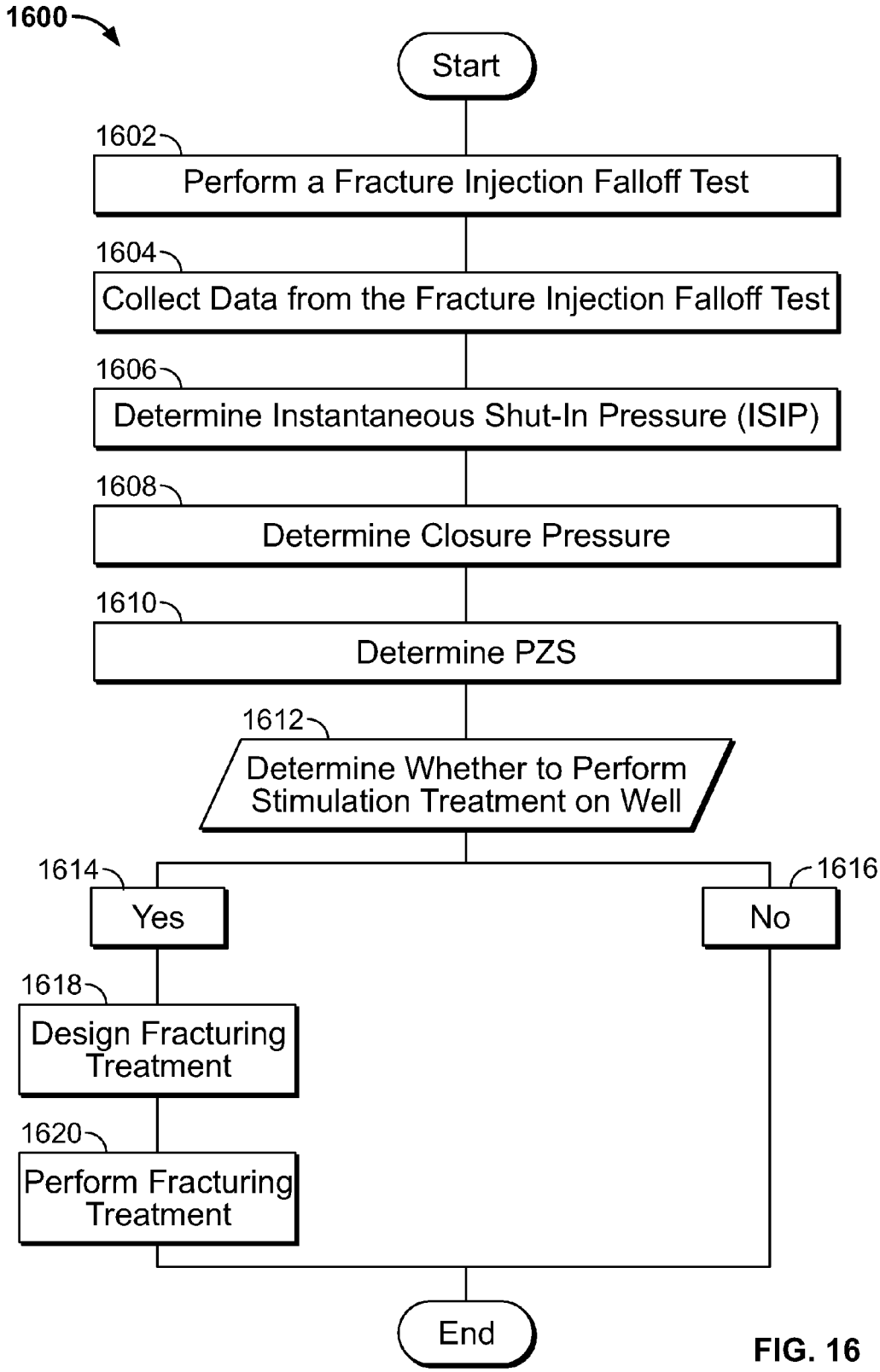
FIG. 16 shows an example method for determining whether to perform a fracturing treatment based on Process Zone Stress.

FIG. 16 is a flowchart for an example method 1600 for determining the use of a stimulation treatment on a well 12. At 1602, an injection shut-in test, such as the DFIT 15, is performed on the well 12 as explained above. The data from the injection shut-in test is collected at 1604. Data may be collected by one or more physical sensors in the well 12 and relayed to the data collection and processing unit 500 for processing by the fracture analysis system 47. At 1606, the ISIP is determined, and the closure pressure is determined at 1608. The ISIP and/or the closure pressure may be determined by the fracture analysis system 47, with or without operator interaction. The ISIP and closure pressure is to obtain the PZS at 1610. By operation of the fracture analysis system 47, PZS may be stored, displayed, printed, or otherwise recorded. At 1612, a determination is made as to whether the determined PZS value indicates a good production potential. In some instances this determination may be performed automatically. At 1614, a good production potential is indicated, and a production stimulation fracture treatment is designed at 1618. This determination may be made based on the determined PZS value equal to or less than a threshold value. Alternately or in combination, this determination may be made based on a normalized PZS gradient value being at or below a threshold value. The production stimulation fracture treatment is performed at 1620. If a poor production potential is indicated at 1616, a production stimulation fracturing treatment is not performed. Thus, in some implementations, a production stimulation fracture treatment may be performed only if the PZS is at or below a threshold. Also, in one or more implementations, a production stimulation fracture treatment may be avoided or not performed if the PZS is above the threshold.

A number of implementations have been described. Nevertheless, it will be understood that various modifications may be made without departing from the spirit and scope of the disclosure. Accordingly, other implementations are within the scope of the following claims.

What is claimed is:

1. A method comprising:

determining a process zone stress for a subterranean zone intersected by a wellbore using a fracture analysis system;

comparing the determined process zone stress to a threshold value correlated to a production potential of the subterranean zone; and determining, based on the comparison, to perform a stimulation treatment to the subterranean zone based at least in part on the determined process zone stress.

2. The method of claim 1, wherein determining a process zone stress for a subterranean zone intersected by a wellbore comprises:

performing a fracture injection falloff test;

collecting data from the fracture injection falloff test; and determining the process zone stress using the collected data.

3. The method of claim 2, wherein determining the process zone stress using the collected data comprises:

determining an instantaneous shut-in pressure;

determining a fracture closure pressure; and determining the process zone stress from the instantaneous shut-in pressure and fracture closure pressure.

4. The method of claim 3, wherein determining a fracture closure pressure comprises utilizing a graphical methodology to determine the fracture closure pressure.

5. The method of claim 4, wherein utilizing a graphical methodology to determine the fracture closure pressure comprises utilizing at least one of a G-function methodology, square-root-of-time methodology, and log-log plot methodology to determine fracture closure pressure.

6. The method of claim 3, wherein determining a fracture closure pressure comprises using a mechanical technique to determine the fracture closure pressure.

7. The method of claim 1, further comprising determining a normalized process zone stress gradient for the subterranean zone, wherein the normalized process zone stress gradient is determined by dividing the process zone stress by a depth of the subterranean zone.

8. The method of claim 7, further comprising:

determining, based on the comparison, that the determined process zone stress is indicative of a poor production potential of the subterranean zone;

comparing the determined normalized process zone stress gradient to a threshold gradient value; and based at least in part on the comparison of the determined normalized process zone stress gradient and the threshold gradient value, determining to perform the stimulation treatment.

9. The method of claim 7 further comprising not performing a stimulation treatment when the normalized process zone stress gradient is greater than 0.12 psi/ft.

10. The method of claim 9, wherein correlating historical production stimulation fracturing data of the well to determine process zone stress comprises generating a history-match fracture model.

11. The method of claim 1, wherein determining the process zone stress comprises correlating historical production stimulation fracturing data of the well to determine process zone stress.

12. A method for determining whether to perform a stimulation treatment on a subterranean zone of a subterranean reservoir, the method comprising:

performing a fracture injection falloff test on the subterranean zone;

collecting well shut-in pressure data after cessation of the fracture injection falloff test;

determining process zone stress of the subterranean zone using the shut-in pressure data;

comparing the determined process zone stress to a threshold value correlated to a production potential of the subterranean zone; and determining, based on the comparison, to perform a stimulation treatment on the subterranean zone based at least in part on the process zone stress.

13. The method of claim 12, wherein determining process zone stress of the subterranean zone using the shut-in pressure data comprises determining a normalized process zone stress gradient.

14. The method of claim 12, wherein determining determine process zone stress of the subterranean zone using the shut-in pressure data comprises:

determining an instantaneous shut-in pressure;

determining a closure pressure; and determining the process zone stress using the instantaneous shut-in pressure and closure pressure.

15. The method of claim 14, wherein determining a closure pressure comprises determining the closure pressure using a graphical methodology.

16. The method of claim 15, wherein determining the closure pressure using a graphical methodology comprises using a G-function methodology, a square-root-of-time methodology, or a log-log plot methodology to determine the closure pressure.

17. The method of claim 12, wherein performing a fracture injection falloff test on the subterranean zone comprises performing a diagnostic fracture injection test.

18. A system for determining whether to perform a stimulation treatment to a subterranean zone based on an estimated profitability potential of the subterranean zone, the system comprising:

a fracture control engine operable to control a fracture injection falloff test performed in a zone of a well; and a fracture analysis engine operable to receive and process data from the fracture injection falloff test for determining a process zone stress and compare the process zone stress to a threshold value correlated to a production potential of the subterranean zone, the fracture control engine operable to control a subsequent fracturing operation only if the process zone stress is below the threshold value.

19. The system of claim 18, wherein the threshold value is between 1,100 psi and 1,900 psi.

20. The system of claim 18, wherein the fracture analysis engine is coupled to one or more sensors adapted to collect the data from the fracture injection falloff test.

21. The system of claim 18, wherein the fracture injection falloff test is a diagnostic fracture injection test.

22. The system of claim 18, wherein the process zone stress is a normalized process zone stress gradient.

23. The system of claim 22, wherein the threshold for the normalized process zone stress gradient is 0.12 psi/ft.

* * * * *

UNITED STATES PATENT AND TRADEMARK OFFICE

CERTIFICATE OF CORRECTION

PATENT NO. : 8,047,284 B2
APPLICATION NO. : 12/395301
DATED : November 1, 2011
INVENTOR(S) : Muthukumarappan Ramurthy et al.

It is certified that error appears in the above-identified patent and that said Letters Patent is hereby corrected as shown below:

In column 14, line 28, in Claim 9, delete "claim 7" and insert --claim 7,--.

In column 14, lines 58-59, delete "determining determine" and insert --determining--.

Signed and Sealed this
Thirty-first Day of January, 2012

David J. Kappos

David J. Kappos
*Director of the United States Patent and Trademark Office*